US005818411A

United States Patent [19]

Sakamoto et al.

[11] Patent Number: 5,818,411

[45] Date of Patent: Oct. 6, 1998

[54] LIQUID CRYSTAL DISPLAY DEVICE

[75] Inventors: Atsushi Sakamoto, Nara; Hiromasa Asada, Ikoma; Toshihiro Ohba, Nara, all of Japan

[73] Assignee: Sharp Kabushiki Kaisha, Osaka, Japan

[21] Appl. No.: 635,700

[22] Filed: Apr. 22, 1996

[30] Foreign Application Priority Data

Apr. 24, 1995 [JP] Japan ..... 7-098825

[51] Int. Cl.[6] ..... G09G 3/36

[52] U.S. Cl. ..... 345/99; 345/87; 345/94

[58] Field of Search ..... 345/58, 77, 78, 345/87, 88, 89, 93, 94, 95, 99

[56] References Cited

U.S. PATENT DOCUMENTS

| | | | |
|---|---|---|---|
| 4,443,741 | 4/1984 | Tanaka et al. | 345/78 |
| 4,511,926 | 4/1985 | Crossland et al. . | |
| 5,111,195 | 5/1992 | Fukuola et al. . | |
| 5,465,102 | 11/1995 | Usui et al. . | |
| 5,583,528 | 12/1996 | Ebihara et al. | 345/94 |
| 5,594,463 | 1/1997 | Sakamoto | 345/78 |

FOREIGN PATENT DOCUMENTS

| | | |
|---|---|---|
| 3-130797 | 10/1992 | Japan . |
| 4276794 | 10/1992 | Japan . |
| 5-333315 | 12/1993 | Japan . |

*Primary Examiner*—Richard A. Hjerpe
*Assistant Examiner*—Kent Chang
*Attorney, Agent, or Firm*—Nixon & Vanderhye, P.C.

[57] ABSTRACT

A liquid crystal display device includes a liquid crystal panel having a plurality of scanning electrodes including first and second scanning electrodes, a plurality of signal electrodes including a first signal electrode, and a liquid crystal layer. A display is generated based on display data including first and second display data. The liquid crystal display device further includes a scanning electrode driver which outputs a scanning voltage to the first scanning electrode in a first scanning period and outputs a scanning voltage to the second scanning electrode in a second scanning period following the first scanning period. A signal electrode driver outputs a first voltage corresponding to the first display data to the first signal electrode in the first scanning period and outputs a second voltage corresponding to the second display data to the first signal electrode in the second scanning period. The signal electrode driver compares the first display data and the second display data and, when the first display data and the second display data are different, outputs a third voltage for correcting a reduction of an effective voltage of the second voltage for a correction duration in the second scanning period.

14 Claims, 11 Drawing Sheets

Output of a signal electrode driving circuit by a conventional driving method

Output of the signal electrode driving circuit 2 shown in Fig.2

Output of the signal electrode driving circuit 2 when the dulling is taken into consideration

*Fig. 7*
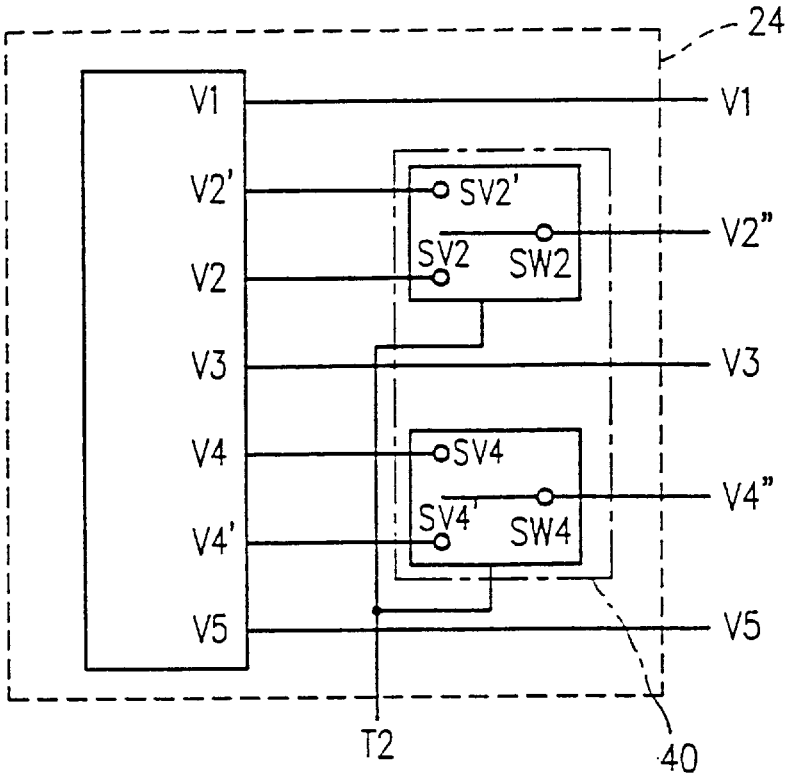
*Fig. 8A*
*Fig. 8B*
*Fig. 8C*
*Fig. 8D*
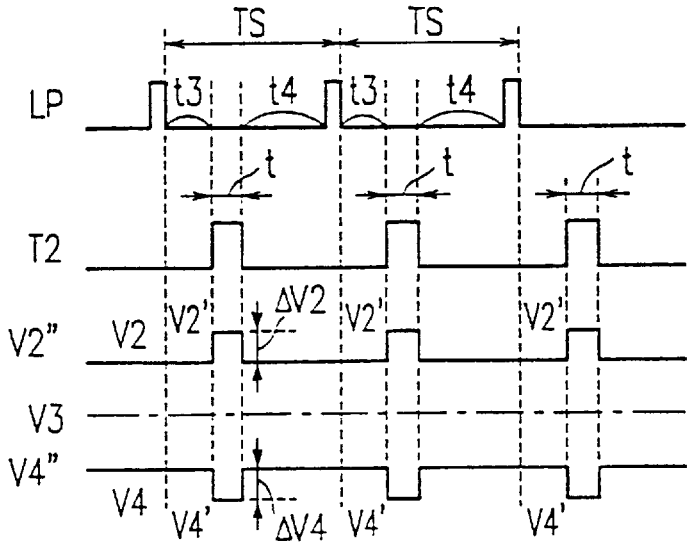

Output of a signal electrode driving circuit by a conventional driving method

Output of the signal electrode driving circuit 22 shown in Fig.5

Output of the signal electrode driving circuit 22 when the dulling is taken into consideration

LIQUID CRYSTAL DISPLAY DEVICE

BACKGROUND OF THE INVENTION

1. Field of the Invention

The present invention relates to a liquid crystal display device using a simple matrix liquid crystal panel driven by a voltage averaging method.

2. Description of the Related Art

In recent years, with the wide spread of personal computers, wordprocessors, and the like, light and thin liquid crystal display devices capable of being driven with a battery have been widely used as the display devices for such apparatuses, in place of CRTs which are large and consume much power.

A simple matrix driving method and an active matrix driving method are known as the method for driving such liquid crystal display devices. The simple matrix driving method is advantageous in that, since nonlinear elements are not necessary for pixels arranged in a matrix, the liquid crystal display device can be fabricated easily and at comparatively low cost. It is however disadvantageous in that, as the display capacity of the liquid crystal display device increases, a display variation depending on the display pattern, i.e., crosstalk is generated, lowering the display quality of the liquid crystal display device.

The display variation will be described by exemplifying a simple matrix liquid crystal display device driven by the voltage averaging method.

First, the configuration of such a simple matrix liquid crystal display device will be described. FIG. 10 is a block diagram schematically showing the configuration of a conventional simple matrix liquid crystal display device. Referring to FIG. 10, the liquid crystal display device includes a liquid crystal panel 101 where a plurality of scanning electrodes Y1 to Y8 and a plurality of signal electrodes X1 to X8 are arranged to cross each other. The conventional liquid crystal display device further includes a signal electrode driving circuit 103 for applying a signal voltage based on display data to the signal electrodes X1 to X8, a scanning electrode driving circuit 103 for applying a voltage to the scanning electrodes Y1 to Y8 sequentially, a power source circuit 104 for generating voltages to be supplied to the signal electrode driving circuit 102 and the scanning electrode driving circuit 103 for driving the liquid crystal display device, and a control circuit 105 for controlling the signal electrode driving circuit 102 and the scanning electrode driving circuit 103.

The power source circuit 104 generates driving voltages V3 and V4 to be supplied to the signal electrode driving circuit 102, as well as driving voltages V1, V3 and V5 to be supplied to the scanning electrode driving circuit 103.

The scanning electrodes Y1 to Y8 are sequentially scanned. Any scanning electrode is applied with the driving voltage V1 or V5 when selected, while it is applied with the driving voltage V3 when not selected. These driving voltages are supplied from the power source circuit 104 via the scanning electrode driving circuit 103. The signal electrodes X1 to X8 are applied with an ON voltage or an OFF voltage supplied from the power source circuit 104 in correspondence with display data. The liquid crystal display device is driven in this way.

The control circuit 105 outputs display data D, a data shift clock CK, a scanning clock LP, and an alternate signal FR to the signal electrode driving circuit 102. It also outputs the scanning clock LP, the alternate signal FR, and a scanning start signal FLK to the scanning electrode driving circuit 103.

For convenience of description, the liquid crystal display device of FIG. 10 shows the case where eight scanning electrodes Y1 to Y8 and eight signal electrodes X1 to X8 are driven at a ⅛ duty and the inversion signal period for alternate driving is every three scanning lines.

The operations of the driving circuits of the liquid crystal display device with the above configuration will be described with reference to the timing chart shown in FIGS. 11A to 11C. Incidentally, in FIG. 10, pixels marked 0 on the liquid crystal panel 101 are in the lighted state, while pixels marked θ are in the non-lighted state.

FIGS. 11A and 11B show waveforms of the scanning clock LP and the alternate signals FR, respectively. FIGS. 11C and 11D show ideal signal voltage waveforms applied to the signal electrodes X2 and X3, respectively. FIG. 11E shows an ideal scanning voltage waveform applied to the scanning electrode Y2. FIGS. 11F and 11G respectively show ideal voltage waveforms applied to a pixel A (located at the crossing of the signal electrode X2 and the scanning electrode Y2) and a pixel B (located at the crossing of the signal electrode X3 and the scanning electrode Y2) in the liquid crystal panel 101 shown in FIG. 10

As is apparent from the waveforms shown in FIGS. 11F and 11G, in ideal conditions the pixels A and B are applied with equal effective voltages, so that the transmittances of the pixels A and B of the liquid crystal panel should be the same. However, as shown in FIG. 10, in the real liquid crystal panel, it is known that when a black/white alternating stripe pattern is displayed with a white background, the pixels for the background which share the same signal electrode with pixels for the stripe pattern (for example pixel B, shaded with hatched marks in FIG. 10) is low in luminance compared with the other pixels for the background (for example pixel A), generating a display variation (crosstalk).

This type of crosstalk significantly lowers the display quality of the liquid crystal display device, which is therefore one of the most important problems to be overcome for the simple matrix liquid crystal display device.

The cause for the generation of crosstalk will be described with reference to the timing chart shown in FIGS. 12A to 12F.

FIGS. 12A to 12B show waveforms of the scanning clock LP and the alternate signal FR, respectively. FIGS. 12C and 12D show ideal signal voltage waveforms applied to the signal electrodes X2 and X3, respectively. The effective values of the ideal signal voltages applied to the signal electrodes X2 and X3 are the same.

In the real liquid crystal panel, however, less than ideal (hereinafter referred to as "dull") waveforms as shown in FIGS. 13E and 13F, are applied to the signal electrodes due to the internal resistance of the signal electrode driving circuit 102 and a resistance component of the signal electrodes in the liquid crystal panel. The rise and fall, i.e., voltage level change, of the dull waveforms are shown as straight lines in FIGS. 12E and 12F for simplification; however, in reality the shapes of the dull waveforms will vary depending on charging/discharging waveforms to capacitances.

As is apparent from FIGS. 12E and 12F, the voltage waveform applied to the signal electrode X3 for the strips pattern has more ups and downs and therefore has more portions to be dulled, compared with the voltage waveform applied to the signal electrode X2. Accordingly, the effective value of the voltage applied to the signal electrode X3 is lower than that of the voltage applied to the signal electrode X2. As a result, pixels connected to the signal electrode X3 (for example pixel B) appear darker than pixels connected to the signal electrode X2 (for example pixel A). Pixel B is an example of crosstalk.

In order to eliminate the crosstalk, a method is proposed where the signal voltage waveform is inverted for a certain duration in a one-scanning line driving period (Japanese Laid-open Patent Publication No. 5 -333315 and No. 4-276794, for example). According to the proposed technique, by setting a certain duration in which the signal voltage level is inverted in a one-scanning line driving period, the signal voltage waveform can be dulled even when the waveform is not dulled based on display data. This makes it possible to equalize the dulling of the signal voltage waveform to some extent, and thus reduce the crosstalk caused by the stripe pattern display.

However, the above proposed method has drawbacks as follows. According to this method, the signal voltage waveform applied to the background display portions which otherwise would not have been dulled is also dulled, to lower the effective value of the signal voltage applied to these portions and thus equalize the dulling of the signal voltage waveforms. As a result, the voltage waveforms applied to the signal electrodes for the background display portions, which occupy the majority of the total signal electrodes of the liquid crystal panel, vary simultaneously in every scanning period. This results in generating a large waveform distortion in the scanning electrodes via capacitances of the liquid crystal layer.

Consequently, a different type of crosstalk from the crosstalk caused by the stripe pattern display increases where, when vertical black lines are displayed with a white background, the top and bottom portions of the lines become brighter. Further, as the size of the liquid crystal panel is larger, the frequency of the generation of the different type of crosstalk becomes more different among the upper, lower, right, and left portions of the liquid crystal panel.

Moreover, according to the above conventional method, the signal voltage waveform must be inverted frequently. As a result, nearly maximum power consumption is always required regardless of the display pattern.

SUMMARY OF THE INVENTION

The liquid crystal display device of this invention including a liquid crystal panel having a plurality of scanning electrodes including first and second scanning electrodes, a plurality of signal electrodes including a first signal electrode, and a liquid crystal layer interposed between the plurality of scanning electrodes and the plurality of signal electrodes, display being conducted based on display data including first and second display data, further including scanning electrode driving means which outputs a scanning voltage to the first scanning electrode in a first scanning period and outputs a scanning voltage to the second scanning electrode in a second scanning period following the first scanning period; and signal electrode driving means which outputs a first voltage corresponding to the first display data to the first signal electrode in the first scanning period and outputs a second voltage corresponding to the second display data to the first signal electrode in the second scanning period, wherein the signal electrode driving means compares the first display data and the second display data and, when the first display data and the second display data are different, outputs a third voltage for correcting a reduction of an effective voltage of the second voltage for a correction duration in the second scanning period.

In one embodiment of the invention, the signal electrode driving means is provided for each of the plurality of signal electrodes.

In another embodiment of the invention, an absolute value of the third voltage is larger than an absolute value of the second voltage.

In still another embodiment of the invention, the signal electrode driving means comprises power source means for generating voltages including the first, second, and third voltages.

In still another embodiment of the invention, the signal electrode driving means compares the first display data and the second display data and, when the first display data and the second display data are the same, outputs the second voltage to the first signal electrode over the entire second scanning period.

In still another embodiment of the invention, the signal electrode driving means further includes voltage switching means for selecting the second voltage or the third voltage as an output of the power source means and output switching means for outputting the second voltage or the third voltage to the first signal electrode or putting an output of the signal electrode driving means in a high-impedance state, and the signal electrode driving means compares the first display data and the second display data and, when the first display data and the second display data are the same, puts the output of the signal electrode driving means in the high-impedance state using the output switching means in the correction duration, while outputting the second voltage to the first signal electrode in the second scanning period excluding the correction duration.

In still another embodiment of the invention, the correction duration is as long as the second scanning period.

According to another aspect of the invention, a method for driving a liquid crystal display device including a liquid crystal panel having a plurality of scanning electrodes including first and second scanning electrodes, a plurality of signal electrodes including a first signal electrode, and a liquid crystal layer interposed between the plurality of scanning electrodes and the plurality of signal electrodes, the display being conducted based on display data including first and second display data is provided. The method includes the steps of: (A) allowing scanning electrode driving means to output a scanning voltage to the first scanning electrode in a first scanning period and output a scanning voltage to the second scanning electrode in a second scanning period following the first scanning period; (B) allowing signal electrode driving means to output a first voltage corresponding to the first display data to the first signal electrode in the first scanning period and output a second voltage corresponding to the second display data to the first signal electrode in the second scanning period; (C) allowing the signal electrode driving means to compare the first display data and the second display data; and (D) allowing the signal electrode driving means to output a third voltage for correcting a reduction of an effective voltage of the second voltage for a correction duration in the second scanning period when the first display data and the second display data are different.

In one embodiment of the invention, the steps (B), (C), and (D) are conducted for each of the plurality of signal electrodes.

In another embodiment of the invention, the step (D) includes the step of allowing the signal electrode driving means to output the second voltage to the first signal electrode over the entire second scanning period when the first display data and the second display data are the same.

In still another embodiment of the invention, the step (D) includes the step of allowing the signal electrode driving means to put the output of the signal electrode driving means in a high-impedance state in the correction duration when the first display data and the second display data are the same and the step of allowing the signal electrode driving means to output the second voltage to the first signal electrode in the second scanning period excluding the correction duration when the first display data and the second display data are the same.

According to another aspect of the invention, a liquid crystal display device including a liquid crystal panel having a liquid crystal layer between a plurality of signal electrodes and a plurality of scanning electrodes formed to cross each other is provided. The device includes: signal electrode driving means for applying a voltage corresponding to display data for displaying images on the liquid crystal panel to the plurality of signal electrodes; scanning electrode driving means for applying a scanning voltage to the plurality of scanning electrodes sequentially; and voltage generating means for supplying voltages required for driving the signal electrode driving means and the scanning electrode driving means to the signal electrode driving means and the scanning electrode driving means, wherein the signal electrode driving means detects whether or not the display data corresponding to a current scanning period has changed from the display data corresponding to a scanning period immediately before the current scanning period for each of the plurality of signal electrodes and outputs, when no change is detected, a normal signal voltage level or, when a change is detected, a correction reference voltage for correcting a reduction of an effective voltage caused by waveform dulling due to the change, to each of the plurality of signal electrodes for a predetermined duration in the current scanning period.

In one embodiment of the invention, the voltage generating means is configured so that it can generate at least one level of the correction reference voltage as voltage levels to be supplied to the signal electrode driving means, and the signal electrode driving means is configured so that output means thereof can selectively output the at least one level of the correction reference voltage, supplied from the voltage generating means, and the signal electrode driving means detects whether or not the display data corresponding to a current scanning period has changed from the display data corresponding to a scanning period immediately before the current scanning period for each of the plurality of signal electrodes and outputs the normal signal voltage level when no change is detected or the correction reference voltage when a change is detected, to each of the plurality of signal electrodes for a predetermined duration in the current scanning period.

In another embodiment of the invention, the voltage generating means has a function of generating at least one level of the correction reference voltage as voltage levels to be supplied to the signal electrode driving means, and comprises voltage switching means for outputting the correction reference voltage instead of the normal signal voltage level for a predetermined duration in the current scanning period to supply to the signal electrode driving means. The signal electrode driving means can select the normal signal voltage level or a high-impedance state as an output, and the signal electrode driving means detects whether or not the display data corresponding to the current scanning period has changed from the display data corresponding to the scanning period immediately before the current scanning period for each of the plurality of signal electrodes and, when no change is detected, put the output in the high-impedance state for a predetermined duration in a scanning period corresponding to a voltage switching period of the voltage generating means or, when a change is detected, selects a signal voltage which is switched to the correction reference voltage level by the voltage switching means for a predetermined duration in the current scanning period.

Thus, the invention described herein makes possible the advantage of providing a liquid crystal display device capable of greatly reducing crosstalk.

These and other advantages of the present invention will become apparent to those skilled in the art upon reading and understanding the following detailed description with reference to the accompanying figures.

BRIEF DESCRIPTION OF THE DRAWINGS

FIG. 7 is an internal block diagram of a power source circuit in Example 2.

FIGS. 8A to 8D show timing charts illustrating the operation of the power source circuit in Example 2.

DESCRIPTION OF THE PREFERRED EMBODIMENTS

The present invention will be described by way of examples with reference to the accompanying drawings as follows.

(EXAMPLE 1)

Figure 1:
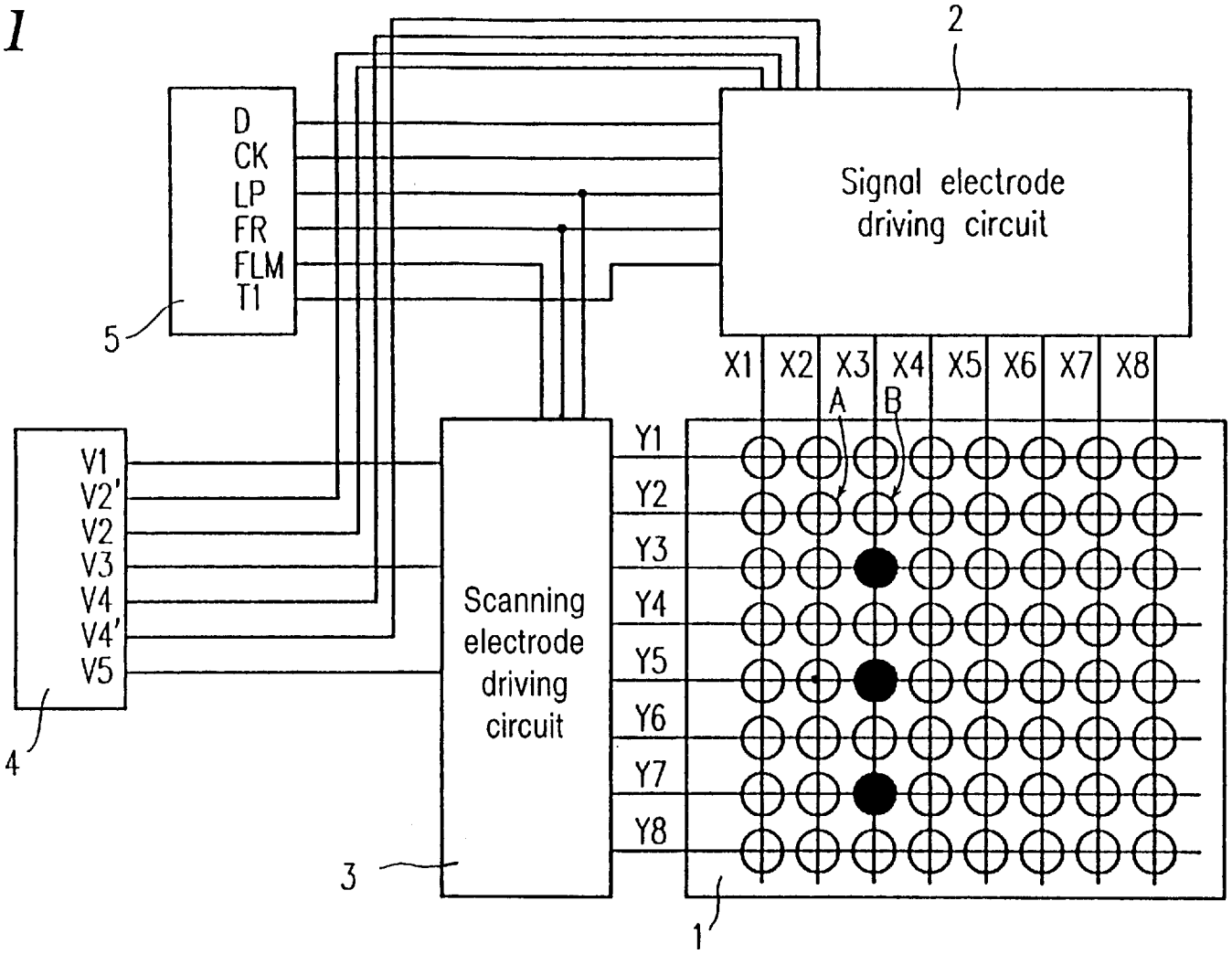
FIG. 1 is a block diagram of a liquid crystal display device of Example 1 according to the present invention.

FIG. 1 is a block diagram schematically showing the configuration of the liquid crystal display device of Example 1 according to the present invention. Referring to FIG. 1, the liquid crystal display device includes a liquid crystal panel 1, a signal electrode driving circuit 2, a scanning electrode driving circuit 3, a power source circuit 4, and a control circuit 5.

The liquid crystal panel 1 includes a plurality of scanning electrodes Y1 to Y8 and a plurality of signal electrodes X1 to X8 arranged to cross each other. The scanning electrode driving circuit 3 scans the scanning electrodes Y1 to Y8 in a linearly sequential manner, and applies a scanning voltage to one of the scanning electrodes Y1 to Y8 during a certain scanning period. The signal electrode driving circuit 2 applies signal voltages based on display data to the signal electrodes X1 to X8. The power source circuit 4 generates voltages to be supplied to the signal electrode driving circuit 2 and the scanning electrode driving circuit 3 for driving the liquid crystal panel. The control circuit 5 controls the signal electrode driving circuit 2 and the scanning electrode driving circuit 3. The signal electrode driving circuit 2 and the power source circuit 4 constitute the signal electrode driving means of the present invention.

Pixels are composed of the signal electrodes, the scanning electrodes, and a liquid crystal layer interposed therebetween. Pixels corresponding to the crossings of the signal electrodes applied with a signal voltage and the scanning electrodes applied with a scanning voltage are lighted, to allow the liquid crystal panel to display desired data.

For simplification, the case where eight signal electrodes X1 to X8 and eight scanning electrodes Y1 to Y8 are driven at a ⅛ duty and the inversion signal period for alternate driving is every three scanning lines is used in the following description.

The liquid crystal display device of this example is basically driven as follows.

The scanning electrode driving circuit 3 scans the scanning electrodes Y1 to Y8 sequentially in response to a scanning clock LP and a scanning start signal FLM input thereinto. Any scanning electrode is applied with a driving voltage V1 or V5 when selected, while it is applied with a driving voltage V3 when not selected. These driving voltages are supplied from the power source circuit 4 via the scanning electrode driving circuit 3. The signal electrodes X1 to X8 are applied with an ON voltage or an OFF voltage supplied from the power source circuit 4 via the signal electrode driving circuit 2 in correspondence with display data. The liquid crystal panel is driven in this way. The basic driving method described so far is the same as the conventional driving method. Hereinbelow, points different from the conventional driving method will be described.

Figure 2:
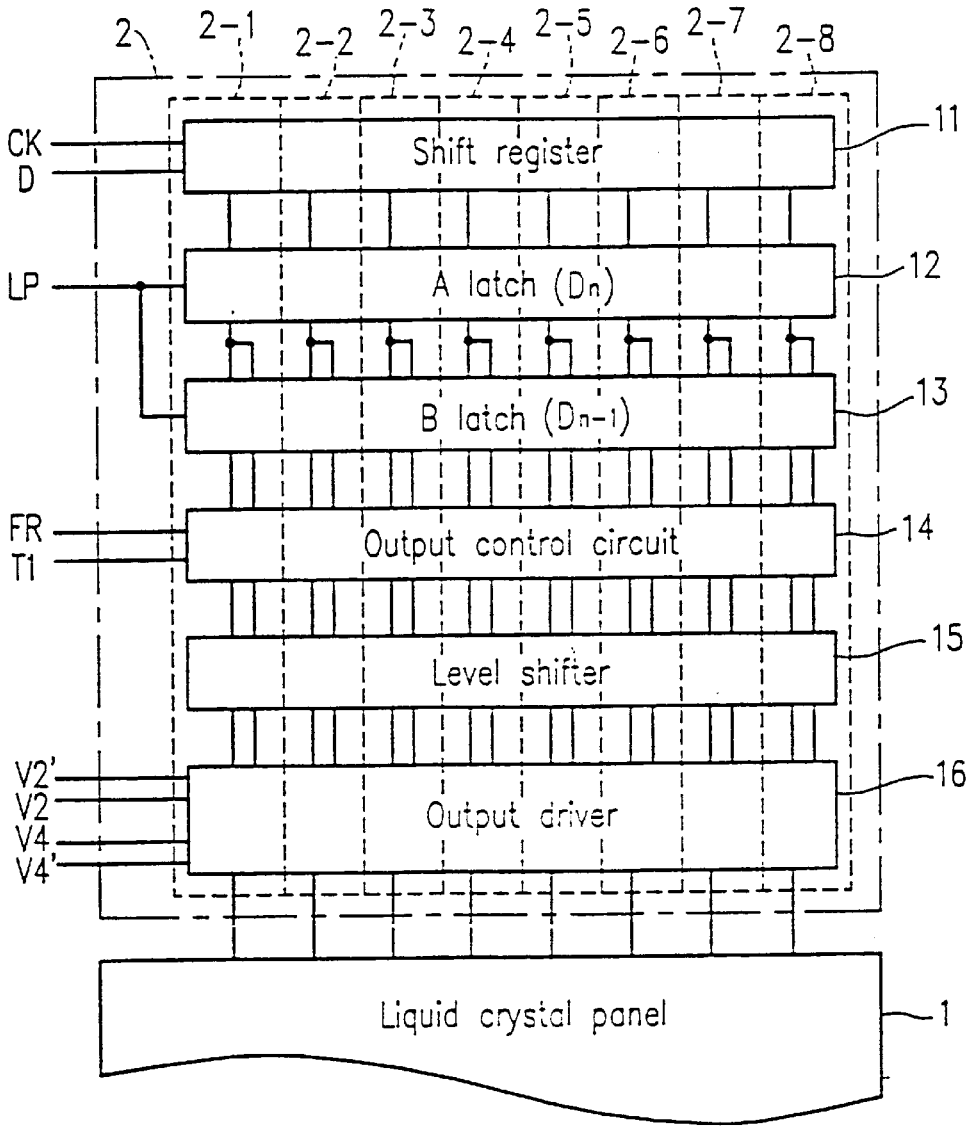
FIG. 2 is an internal block diagram of a signal electrode driving circuit in Example 1.

FIG. 2 is an internal block diagram of the signal electrode driving circuit 2 shown in FIG. 1. Referring to FIG. 2, the signal electrode driving circuit 2 includes circuit portions 2-1 to 2-8 with the same configuration, each of which includes a shift register 11, an A latch 12, a B latch 13, an output control circuit 14, a level shifter 15, and an output driver 16. The circuit portions 2-1 to 2-8 are connected to the signal electrodes X1 to X8, respectively, and supply signal voltages based on display data to the signal electrodes X1 to X8.

The shift register 11 transmits display data D to the A latch 12 in response to a data shift clock CK. The A latch 12 retains display data $D_n$ corresponding to one scanning line upon receipt of the data in response to the scanning clock LP. The B latch 13 retains display data $D_{n-1}$ corresponding to a scanning line immediately before the above scanning line in response to the scanning clock LP.

The output control circuit 14 receives a correction duration control signal T1 and an alternate signal FR. The correction duration control signal T1 sets a duration for correcting a reduction of the effective value of the signal voltage due to dulled signal voltage waveform. The output control circuit 14 compares the display data $D_n$ and $D_{n-1}$ output from the A latch 12 and the B latch 13, respectively, based on the correction duration control signal T1 and the alternate signal FR, to detect whether or not the display data $D_n$ and $D_{n-1}$ are continuous. Based on the above detection result, the output control circuit 14 outputs a 2-bit signal to the output driver 16 to allow the output driver 16 to select the output voltage.

Based on the signal received from the output control circuit 14, the output driver 16 outputs a normal signal voltage V2 or V4 or a correction reference voltage V2' or V4'. The correction reference voltages V2' and V4' and the normal signal voltages V2 and V4 have the relationship of: $V2'>V2$, $|V2'|>|V2|$, $V2'=V2+\Delta V2$; and $V4'<V4$, $|V4'|>|V4|$, $V4'=V4+\Delta V4$. The correction reference voltages V2' and V4' are supplied from the power source circuit 4. The values $\Delta V2$ and $\Delta V4$ are voltage correction amounts for the correction reference voltages V2' and V4', respectively, which are herein referred to as correction voltages.

Figure 3:
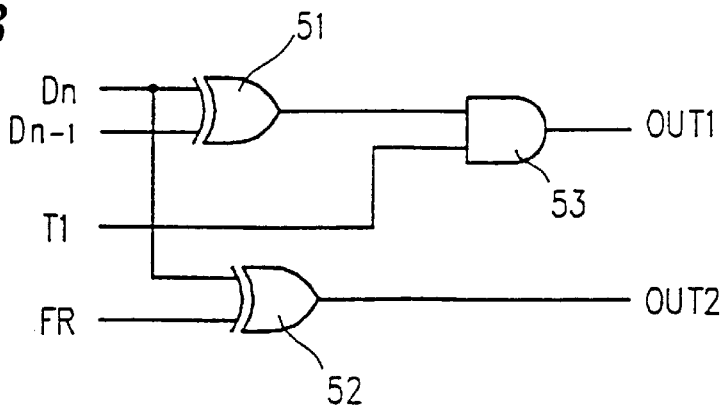
FIG. 3 is a logical circuit diagram showing a portion of the signal electrode driving circuit in Example 1.

The output control circuit 14 can be easily configured using a general-use logical circuit. FIG. 3 shows an example of the configuration of the output control circuit 14. Referring to FIG. 3, the output control circuit 14 is mainly composed of an EXOR (exclusive OR) gate 51 which receives the display data $D_n$ corresponding to one scanning period and the display data $D_{n-1}$ corresponding to a scanning period immediately before the above scanning period, an EXOR gate 52 which receives the display data $D_n$ and the alternate signal FR, and an AND gate 53 which receives the correction duration control signal T1 for setting the period in which the correction reference voltage V2' or V4' is applied and the output of the EXOR gate 51. The detection whether or not the display data $D_n$ and $D_{n-1}$ are continuous as described above is conducted by the EXOR gate 51. The output of the EXOR gate 51 becomes a high (H) level only when the input display data $D_n$ and $D_{n-1}$ are different, indicating that a change has occurred between the display data $D_n$ and $D_{n-1}$.

The output control circuit 14 with the configuration as shown in FIG. 3 operates based on a truth table of Table 1 below. In Table 1, OUT1 and OUT2 respectively denote the outputs of the AND gate 53 and the EXOR gate 52. "Output voltage" denotes the output of the power source circuit 4 selected by the output driver 16.

TABLE 1

| FR | $D_{n-1}$ | $D_n$ | T1 | OUT1 | OUT2 | Output voltage | Case No. |
|---|---|---|---|---|---|---|---|
| L | L | L | L | L | L | V4 | |
| | | | H | L | L | V4 | (2) |
| | H | L | L | L | L | V4 | |
| | | | H | H | L | V4' | (1) |
| | L | H | L | L | H | V2 | |
| | | | H | H | H | V2' | (1) |
| | H | H | L | L | H | V2 | |
| | | | H | L | H | V2 | (2) |
| H | L | L | L | L | H | V2 | |
| | | | H | L | H | V2 | (2) |
| | H | L | L | L | H | V2 | |
| | | | H | H | H | V2' | (1) |
| | L | H | L | L | L | V4 | |
| | | | H | H | L | V4' | (1) |
| | H | H | L | L | L | V4 | |
| | | | H | L | L | V4 | (2) |

The output control circuit 14 outputs a 2-bit signal composed of OUT1 and OUT2 to the output driver 16. The output driver 16 selects one of the voltages V2, V4, V2', and V4' in response to the 2-bit signal and based on the truth table shown in Table 1 and outputs the result.

Figures 4A, 4B, 4C, 4D, 4E:
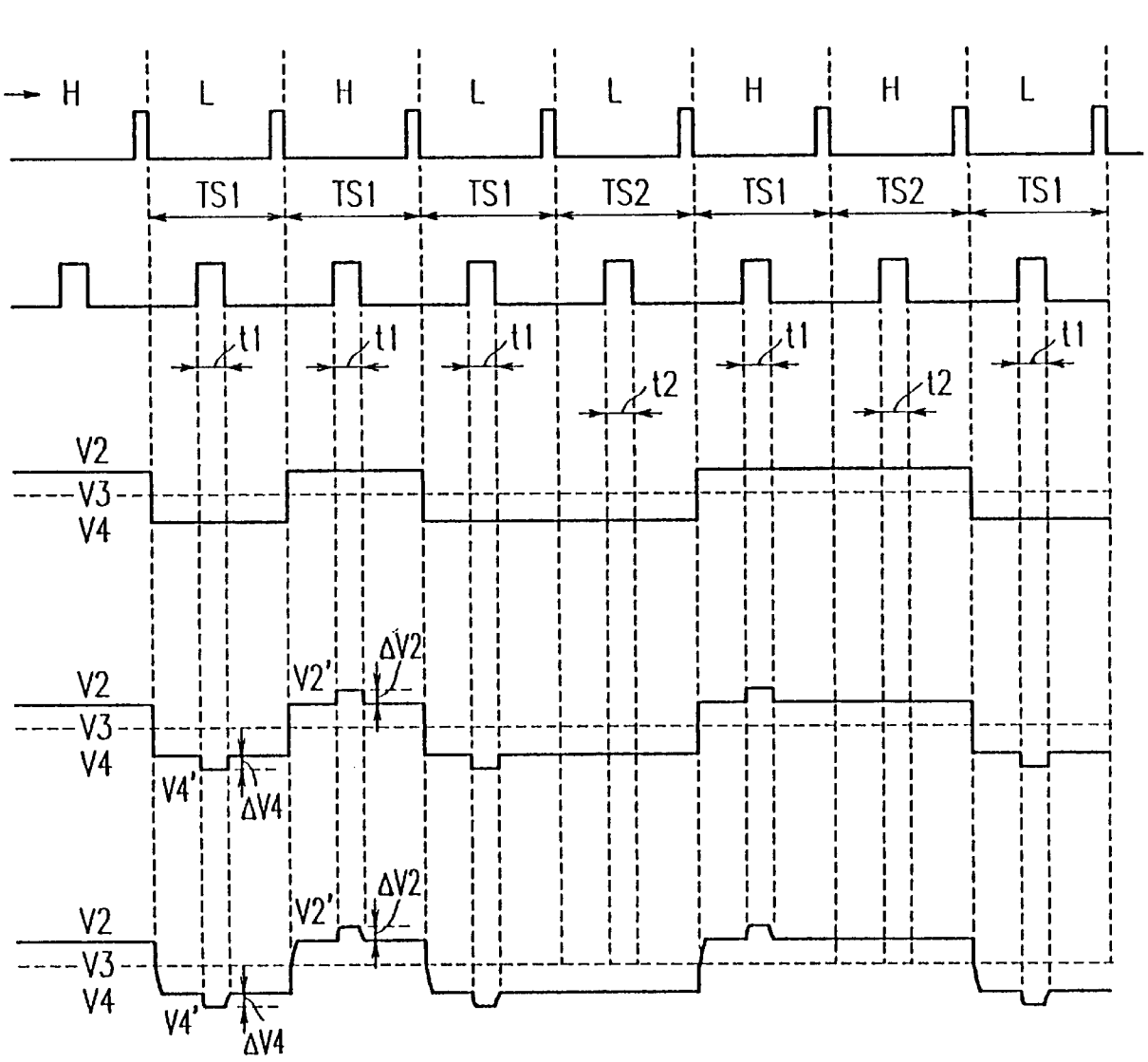
FIGS. 4A to 4E show timing charts illustrating the operation of the liquid crystal display device of Example 1.

Next, the operation of the signal electrode driving circuit 2 shown in FIG. 2 will be described with reference to the timing charts shown in FIGS. 4A to 4E. FIG. 4A shows the waveform of the scanning clock LP. FIG. 4B shows the waveform of the correction duration control signal T1. The duration in which the correction duration control signal T1 is high (H) corresponds to the period in which the correction reference voltage V2' or V4' is output from the signal electrode driving circuit 2. FIG. 4C shows the output of a signal electrode driving circuit driven by a conventional driving method where the correction reference voltage V2' or V4' is not used. FIG. 4D shows the output of the signal electrode driving circuit 2 shown in FIG. 2. FIG. 4E shows the output of the signal electrode driving circuit 2 when the waveform dulling is taken into consideration.

As shown in FIG. 4D, when the display data $D_n$ corresponding to a current scanning period TS1 is different from the display data $D_{n-1}$ corresponding to a scanning period immediately before the current scanning period TS1, the output driver 16 outputs the correction reference voltage V2' or V4' to the corresponding signal electrode for a duration t1 in which the signal T1 is high in the current scanning period TS1. The correction reference voltage V2' or V4' corresponds to the output voltage denoted by (1) in Table 1.

On the other hand, when the display data $D_n$ corresponding to a current scanning period TS2 is the same as (i.e., continuous with) the display data $D_{n-1}$ corresponding to a scanning period immediately before the current scanning period TS2, the output driver 16 outputs the normal signal voltage V2 or V4 to the corresponding signal electrode even for a duration t2 in which the signal T1 is high in the current scanning period TS2. The normal signal voltage V2 or V4 corresponds to the output voltage denoted by (2) in Table 1.

Thus, the signal electrode driving circuit 2 in this example is configured so that, when the signal voltage waveform is dulled, the correction reference voltage V2' or V4' for correcting the dulled waveform is applied to the signal electrode in one scanning period TS1. With this configuration, it is possible to apply the correction reference voltage V2' or V4' obtained by superimposing the correction voltage ΔV2 or ΔV4 to the normal signal voltage V2 or V4 to the signal electrode in the scanning period TS1 in which the signal voltage corresponding to display data has changed from that in the preceding period.

The effective values of the signal voltages applied to all the signal electrodes can be made identical, not depending on display data, by setting the duration t1 in which the correction reference voltage V2' or V4' is applied and the correction reference voltage V2' or V4' at respective optimal values in consideration of the size of the liquid crystal panel, the characteristics of the liquid crystal material, and the like. As a result, crosstalk can be greatly reduced.

FIG. 4E shows the voltage waveform output from the signal electrode driving circuit 3 when the waveform dulling is taken into consideration. As shown in FIG. 4E, the duration t1 in which the correction reference voltage V2' or V4' is applied and the value of the correction reference voltage V2' or V4' are set so that the waveform dulling can be compensated. The correction reference voltage V2' or V4' was applied only for a certain duration in the scanning period TS1 in this example. However, a lower-level correction reference voltage obtained by reducing the correction voltage ΔV2 or ΔV4 may be applied over the entire scanning period TS1.

In this example, two levels of voltages V2' and V4' were used as the correction reference voltage. The same results can be obtained by using only one of the correction reference voltages V2' and V4' and increasing the correction amount ΔV2 or ΔV4 to compensate the omission of one correction reference voltage.

In many cases, the signal electrode driving circuit is divided into a plurality of portions and each of such portions is packaged into an IC. In such a case, it is possible to correct the difference in the level of crosstalk depending on the position in the liquid crystal panel by slightly shifting the correction duration t1 for each of the plurality of ICs arranged in the lateral direction of the liquid crystal panel.

(Example 2)

Figure 5:
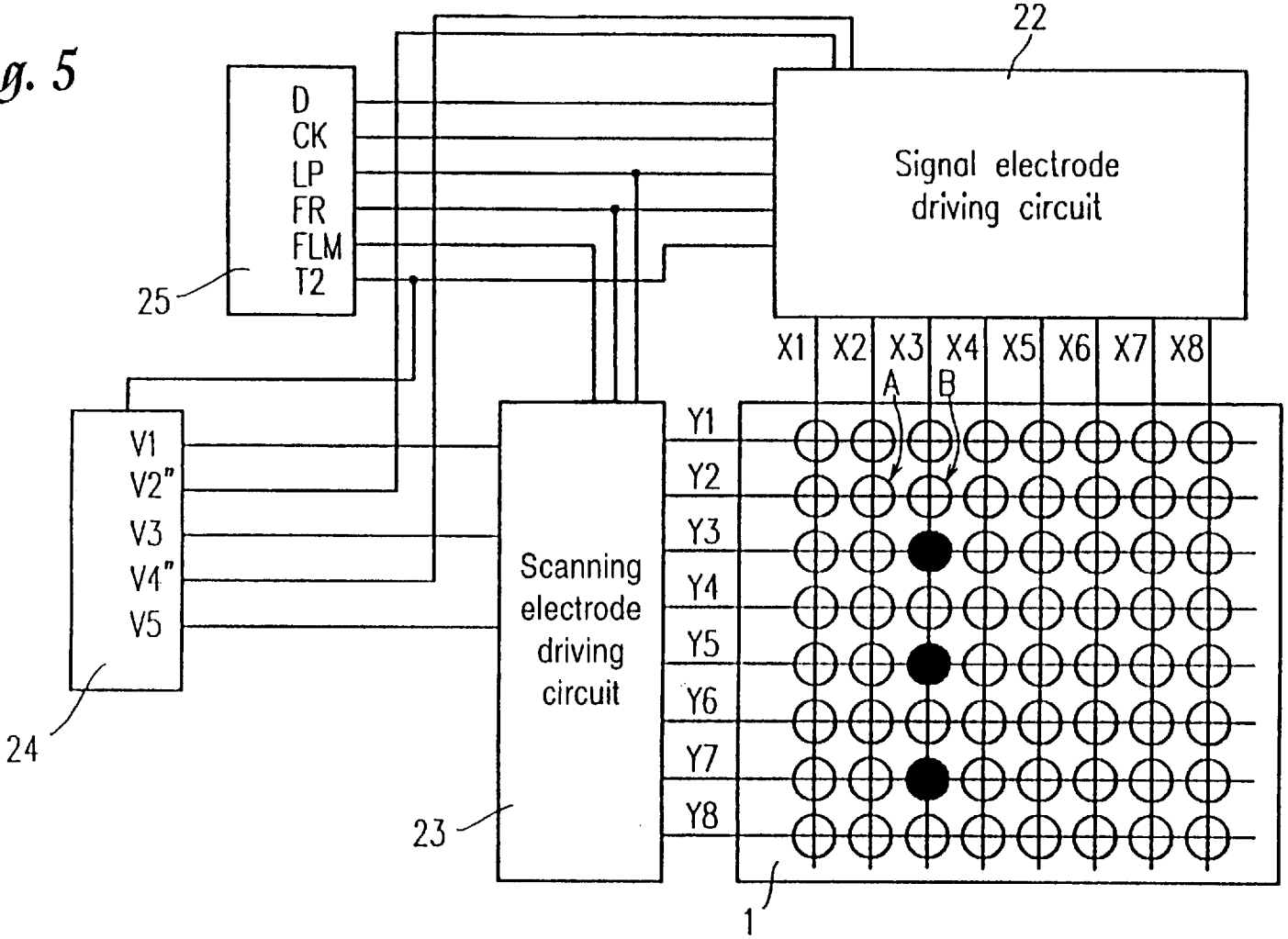
FIG. 5 is a block diagram of a liquid crystal display device of Example 2 according to the present invention.

FIG. 5 is a block diagram schematically showing the configuration of the liquid crystal display device of Example 2 according to the present invention. Referring to FIG. 5, the liquid crystal display device includes a liquid crystal panel 1, a signal electrode driving circuit 22, a scanning electrode driving circuit 23, a power source circuit 24, and a control circuit 25.

The liquid crystal panel 1 includes a plurality of scanning electrodes Y1 to Y8 and a plurality of signal electrodes X1 to X8 arranged to cross each other. The scanning electrode driving circuit 23 scans the scanning electrodes Y1 to Y8 in a linearly sequential manner, and applies a scanning voltage to one of the scanning electrodes Y1 to Y8 during a certain scanning period. The signal electrode driving circuit 22 applies signal voltages based on display data to the signal electrodes X1 to X8. The power source circuit 24 generates voltages to be supplied to the signal electrode driving circuit 22 and the scanning electrode driving circuit 23 for driving the liquid crystal panel. The control circuit 25 controls the signal electrode driving circuit 22 and the scanning electrode driving circuit 23. The signal electrode driving circuit 22 and the power source circuit 24 constitute the signal electrode driving means of the present invention.

For simplification, the case where eight signal electrodes X1 to X8 and eight scanning electrodes Y1 to Y8 are driven at a ⅛ duty and the inversion signal period for alternate driving is every three scanning lines will be used in the following description.

The liquid crystal display device of this example is basically driven as follows: The scanning electrode driving circuit 23 scans the scanning electrodes Y1 to Y8 sequentially in response to a scanning clock LP and a scanning start signal FLH input thereinto. Any scanning electrode is applied with a driving voltage V1 or V5 when selected, while it is applied with a driving voltage V3 when not selected. These driving voltages are supplied from the power source circuit 24 via the scanning electrode driving circuit 23. The signal electrodes X1 to X8 are applied with an ON voltage or an OFF voltage supplied from the power source circuit 24 via the signal electrode driving circuit 22 in correspondence with display data. The liquid crystal panel is driven in this way. The basic driving method described so far is the same as the conventional driving method. Hereinbelow, points different from the conventional driving method will be described.

Figure 6A:
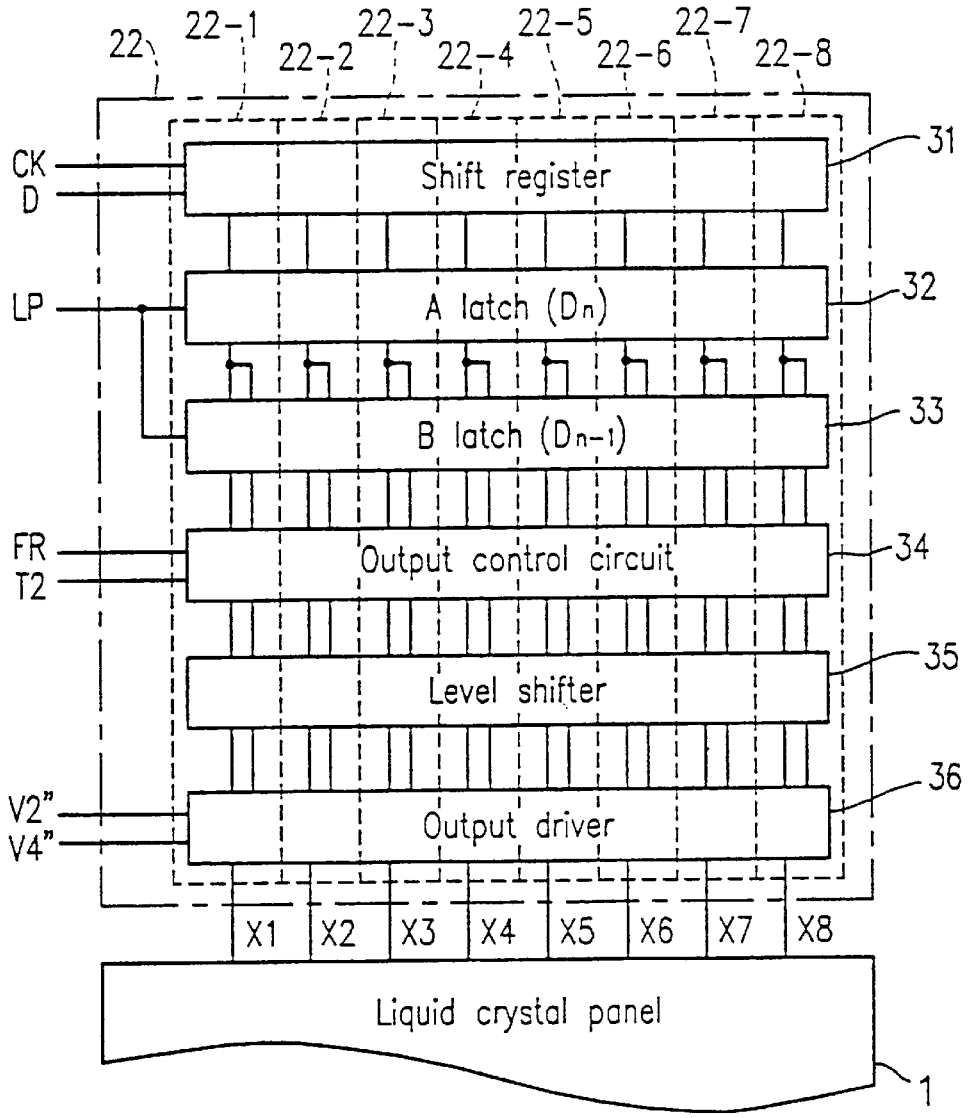
FIG. 6A is an internal block diagram of a signal electrode driving circuit in Example 2.

FIG. 6A is an internal block diagram of the signal electrode driving circuit 22 shown in FIG. 5. Referring to FIG. 6A, the signal electrode driving circuit 22 includes a shift register 31, an A latch 32, a B latch 33, an output control circuit 34, a level shifter 35, and an output driver 36. The signal electrode driving circuit 22 includes circuit portions 22-1 to 22-8 which correspond to the signal electrodes X1 to X8, respectively. The circuit portions 22-1 to 22-8 are connected to the signal electrodes X1 to X8, respectively, and supply signal voltages based on display data to the signal electrodes X1 to X8. The output driver 36 includes output driver portions 36-1 to 36-8 which are included in the circuit portions 22-1 to 22-8, respectively.

The shift register 31 transmits display data D to the A latch 32 in response to a data shift clock CK. The A latch 32 retains display data $D_n$ corresponding to one scanning line upon receipt of the data in response to the scanning clock LP. The B latch 33 retains display data $D_{n-1}$ corresponding to a scanning line immediately before the above scanning line in response to the scanning clock LP.

The output control circuit 34 compares the display data $D_n$ and $D_{n-1}$ output from the A latch 32 and the B latch 33, respectively, based on a correction duration control signal T2 and an alternate signal FR, to detect whether or not the display data $D_n$ and $D_{n-1}$ are continuous. Based on the detection result, the output control circuit 34 outputs 2-bit signals (OUT1 and OUT2) to the output driver 36 to allow the output driver 36 to select the output voltage. The output control circuit 34 can be easily configured using a logical circuit. The output control circuit 34 may have the same configuration as that shown in FIG. 3 in Example 1.

Figure 6B:
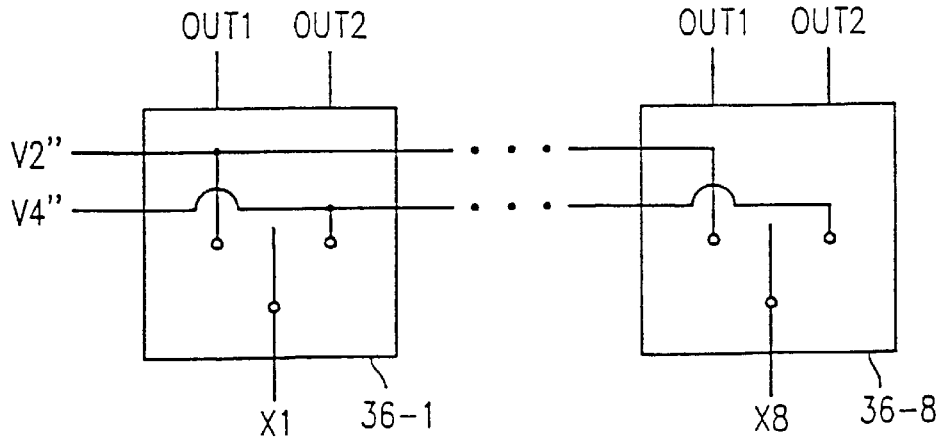
FIG. 6B is an internal block diagram of an output driver in Example 2.

The output driver portions 36-1 to 36-8 have a switch circuit with a configuration shown in FIG. 6B. The operation of the output driver 36 will be described as follows taking the output driver portion 36-1 as an example. The output driver portion 36-1 selects a voltage of a power source line V2" or a voltage of a power source line V4" from the power source circuit 24 based on the signals OUT1 and OUT2 input from an output control circuit portion 34-1 and outputs the selected voltage to the signal electrode X1 under certain conditions. Under other conditions, the output driver portion 36-1 outputs no voltage of the power source line V2" nor V4" to the signal electrode X1. That is, the output driver portion 36-1 and the signal electrode X1 are electrically isolated from each other. This state is referred to as the high-impedance (HZ) state of the output of the output driver 36 or the high-impedance (HZ) state of the output of the signal electrode driving circuit 22.

The voltage of the power source line V2" includes a normal signal voltage V2 and a correction reference voltage V2'. The voltage of the power source line V4" includes a normal signal voltage V4 and a correction reference voltage V4'. The correction reference voltages V2' and V4' and the normal signal voltages V2 and V4 have the relationship of: $V2'>V2$, $|V2'|>|V2|$, $V2'=V2+\Delta V2$; and $V4'<V4$, $|V4'|>|V4|$, $V4'=V4+\Delta V4$. The values $\Delta V2$ and $\Delta V4$ are voltage correction amounts for the correction reference voltages V2' and V4', respectively.

The power source circuit 24 has the internal configuration shown in FIG. 7. Referring to FIG. 7, the power source circuit 24 includes a voltage switching circuit 40 which has two switch circuits SW2 and SW4. The operation of the switch circuits SW2 and SW4 is controlled by the correction duration control signal T2 input into the switch circuits SW2 and SW4.

The operation of the power source circuit 24 having the voltage switching circuit 40 will be described with reference to the timing charts shown in FIGS. 8A to 8D.

FIG. 8A shows the waveform of the scanning clock LP. FIG. 8B shows the waveform of the correction duration control signal T2. A duration t in which the correction duration control signal T2 is high (H) corresponds to the duration in which the correction reference voltage V2' or V4' is output from the power source circuit 24. FIGS. 8C and 8D show the waveforms of output voltages of the power source lines V2" and V4" of the power source circuit 24, respectively.

Referring to FIGS. 8A to 8D, the switch circuit SW2 of the voltage switching circuit 40 shown in FIG. 7 is connected to a terminal SV2 of the voltage V2 line for a duration t3 preceding the duration t in which the correction duration control signal T2 is turned high in a scanning period TS. Thus, in the duration t3, the normal signal voltage V2 is output as the voltage of the power source line V2".

The switch circuit SW2 selects a terminal SV2' of the voltage V2' line in the duration t in which the correction duration control signal T2 is high. The correction reference voltage V2' is then output as the voltage of the power source line V2".

The switch circuit SW2 is connected again to the terminal SV2 of the voltage V2 line for a duration t4 following the duration t in which the correction duration control signal T2 is high. Thus, the normal signal voltage V2 is output as the voltage of the power source line V2".

The switch circuit SW4 operates in the same manner as the switch circuit SW2 described above. That is, when the switch circuit SW4 selects a terminal SV4 of the voltage V4 line (durations t3 and t4), the normal signal voltage V4 is output as the voltage of the power source line V4". On the contrary, when the switch circuit SW4 selects a terminal SV4' of the voltage V4' line (duration t), the correction reference voltage V4' is output as the voltage of the power source line V4".

As is shown in FIGS. 8C and 8D, the correction reference voltages V2' and V4' are obtained by superimposing the correction voltages $\Delta V2$ and $\Delta V4$ to the normal signal voltages V2 and V4, respectively.

The output control circuit 34 with the configuration as shown in FIG. 3 operates based on a truth table of Table 2 below.

TABLE 2

| FR | $D_{n-1}$ | $D_n$ | T2 | OUT1 | OUT2 | Output voltage | Case No. |
|---|---|---|---|---|---|---|---|
| L | L | L | L | L | L | V4 | (1) |
| | | | H | L | L | HZ | (2) |
| | H | L | L | L | L | V4 | (3) |
| | | | H | H | L | (V4') | (4) |
| | L | H | L | L | H | V2 | (5) |
| | | | H | H | H | (V2') | (6) |
| | H | H | L | L | H | V2 | (7) |
| | | | H | L | H | HZ | (8) |
| H | L | L | L | L | H | V2 | (9) |
| | | | H | L | H | HZ | (10) |
| | H | L | L | L | H | V2 | (11) |
| | | | H | H | H | (V2') | (12) |
| | L | H | L | L | L | V4 | (13) |
| | | | H | H | L | (V4') | (14) |
| | H | H | L | L | L | V4 | (15) |
| | | | H | L | L | HZ | (16) |

In Table 2, OUT1 and OUT2 respectively denote the outputs of the AND gate 53 and the EXOR gate 52 shown in FIG. 3. "Output voltage" denotes the output of the output driver 36. The output control circuit 34 outputs a 2-bit signal composed of OUT1 and OUT2 to the output driver 36. Based on the 2-bit signal, the output driver 36 selects one of the voltages of the power source line V2" (V2 and V2') or one of the voltages of the power source line V4" (V4 and V4') as the output of the power source circuit 24 to be supplied to the corresponding signal electrodes, or the output of the output driver 36 is put in the high-impedance (HZ) state.

Hereinbelow, the operation of the output driver 36 selecting an appropriate voltage (V2, V2', V4, or V4') of the power source circuit 24 or putting the output thereof in the high-impedance state will be described with reference to Table 2 and FIGS. 7 and 8A to 8D.

As shown in Table 2, when the output OUT2 is low (L) as in cases (1)–(4) and (13)–(16), the output driver 36 selects the voltage V4 or V4' of the power source line V4" from the power source circuit 24, or the output of the output driver 36 is put in the high-impedance (HZ) state. On the contrary, when the output OUT2 is high (H) as in cases (5)–(12), the output driver 36 selects the voltage V2 or V2' of the power source line V2" from the power source circuit 24, or the output of the output driver 36 is put in the high-impedance (HZ) state.

The operations of the power source circuit 24 and the output driver 36 when the voltage V4 or V4' of the power source line V4" is selected or the output of the output driver 36 is put in the high-impedance (HZ) state, i.e., cases (1)–(4), will be described in detail.

As shown in cases (1) and (3) of Table 2, for the duration in which the correction duration control signal T2 is low, the output driver 36 selects the voltage V4 of the power source line V4" from the power source circuit 24. The duration in which the voltage V4 of the power source line V4" is selected corresponds to the durations t3 and t4 shown in FIGS. 8A to 8D.

As shown in case (4) of Table 2, when the correction duration control signal T2 is high and the output OUT1 is also high, the output driver 36 selects the voltage V4' of the power source line V4" from the power source circuit 24. The voltage V4' is indicated as (V4') in Table 2. The duration in which the voltage V4' of the power source line V4" is selected corresponds to the duration t shown in FIGS. 8A to 8D.

As shown in case (2) of Table 2, when the correction duration control signal T2 is high and the output OUT1 is low, the output driver 36 puts the output thereof in the high-impedance (HZ) state.

The operation of the output driver 36 selecting the voltage V2 or V2' of the power source line V2" from the output of the power source circuit 24 or putting the output thereof in the high-impedance (HZ) state (cases (5) to (12) of Table 2) are the same as those described above for the cases (1) to (4), and therefore the description thereof is omitted.

The output finally supplied to the signal electrodes in Example 2 has the same waveform as that in Example 1 shown in FIGS. 4D and 4E. FIGS. 9A to 9E show the waveforms according to Example 2 corresponding to those shown in FIGS. 4A to 4E, respectively. Durations tH2 and tH4 shown in FIGS. 9A to 9E correspond to the duration in which the output driver 36 puts the output thereof in the high-impedance (HZ) state.

Figures 9A, 9B, 9C, 9D, 9E:
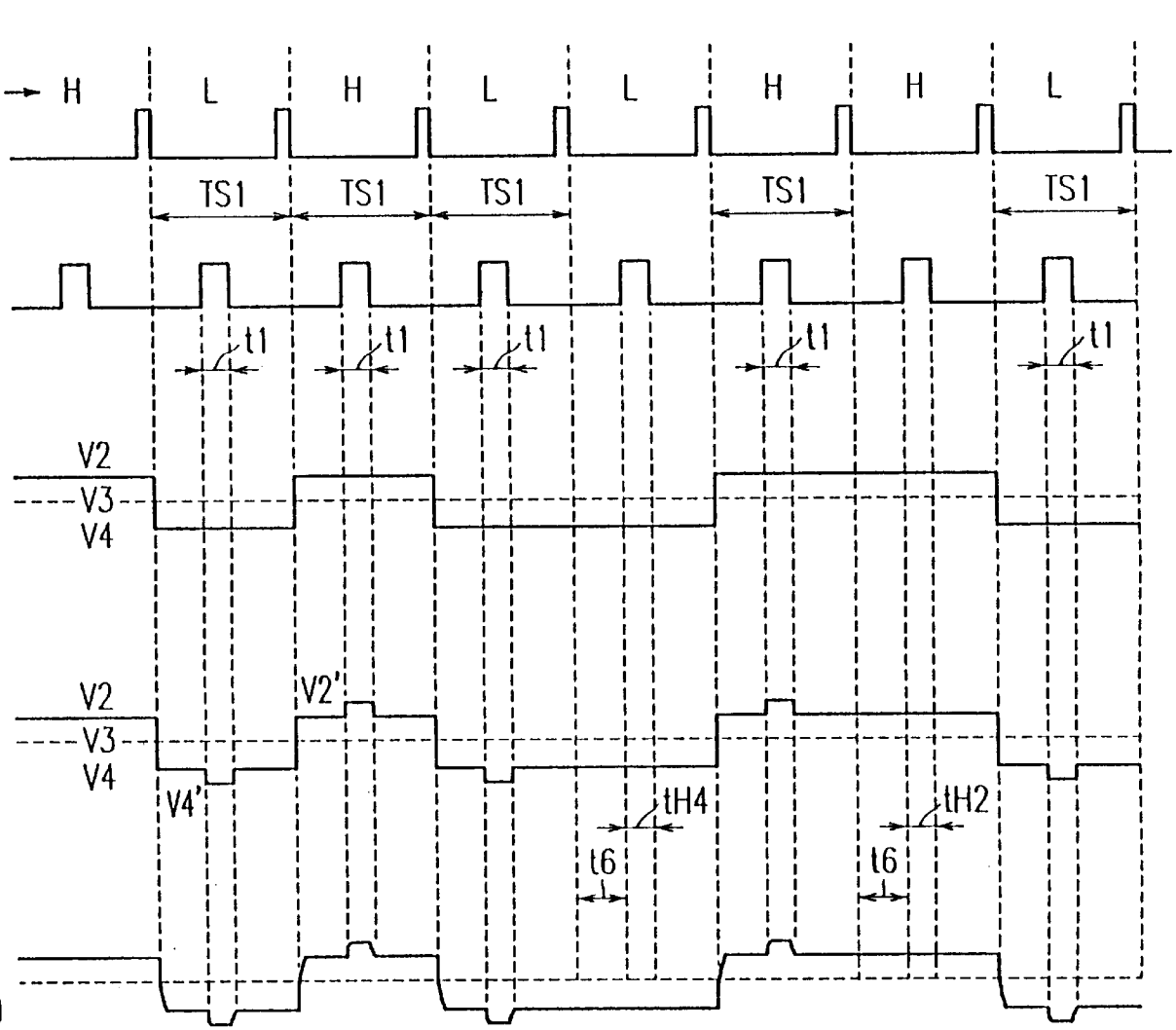
FIGS. 9A to 9E show timing charts illustrating the operation of the liquid crystal display device of Example 2.
Figure 10:
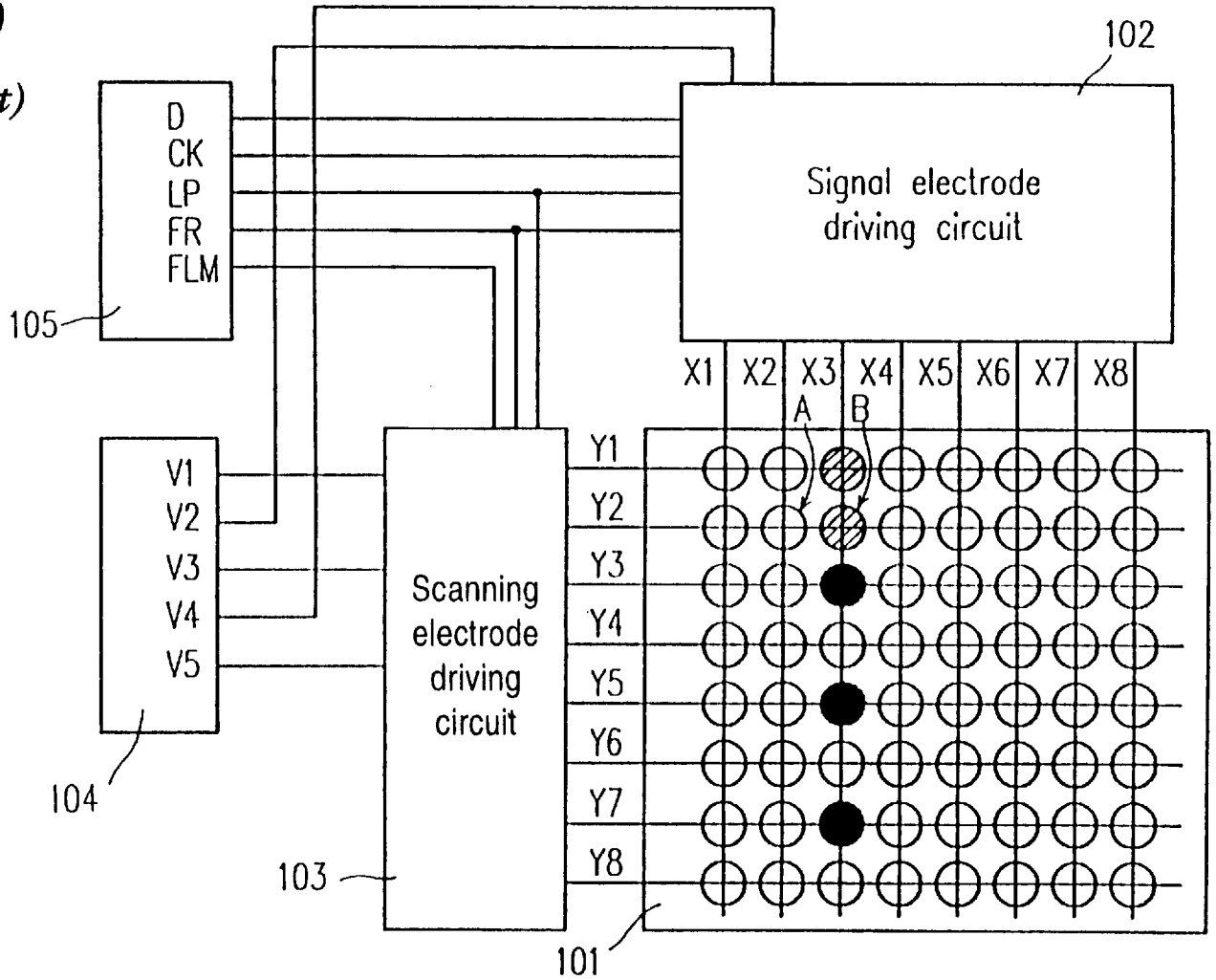
Fig. 10 (Prior Art)
FIG. 10 is a block diagram of a conventional liquid crystal display device.
Figures 11A, 11B, 11C, 11D, 11E, 11F, 11G:
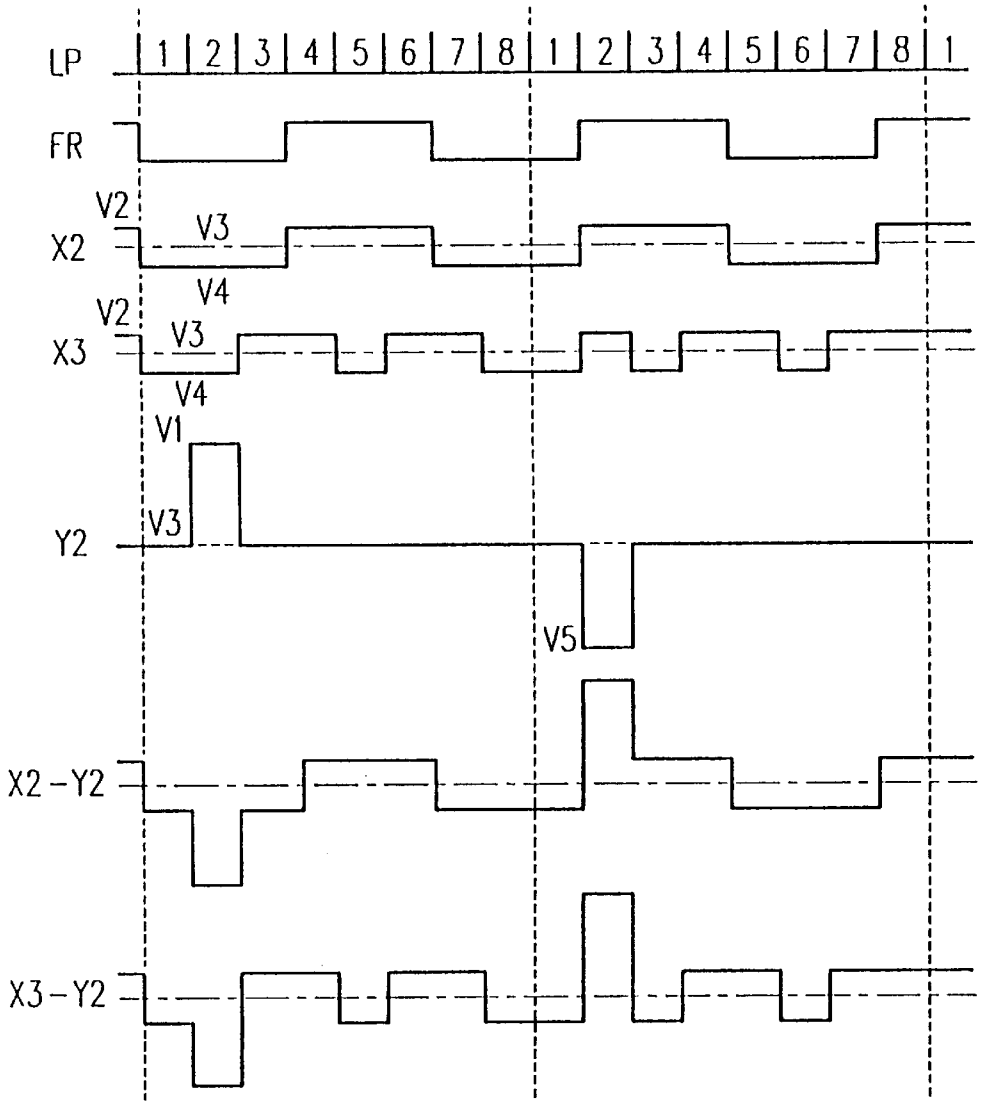
Fig. 11A (Prior Art)
Fig. 11B (Prior Art)
Fig. 11C (Prior Art)
Fig. 11D (Prior Art)
Fig. 11E (Prior Art)
Fig. 11F (Prior Art)
Fig. 11G (Prior Art)
FIGS. 11A to 11G show timing charts illustrating the operation of the conventional liquid crystal display device of FIG. 10 in ideal conditions.
Figures 12A, 12B, 12C, 12D, 12E, 12F:
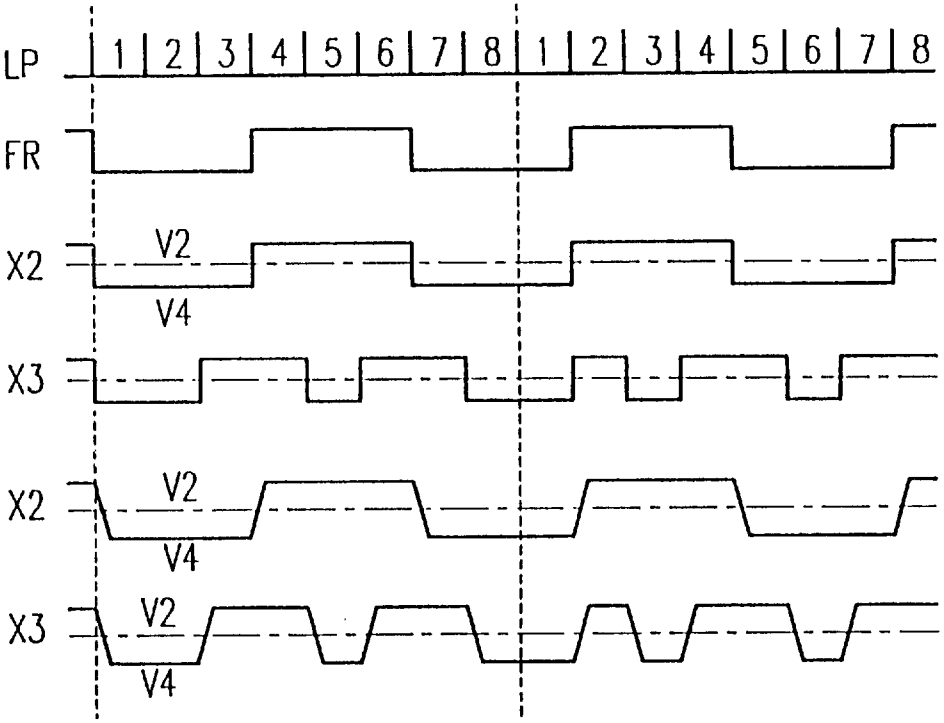
Fig. 12A (Prior Art)
Fig. 12B (Prior Art)
Fig. 12C (Prior Art)
Fig. 12D (Prior Art)
Fig. 12E (Prior Art)
Fig. 12F (Prior Art)
FIGS. 12A to 12F show timing charts for describing the cause of crosstalk in the conventional liquid crystal display device.

Though no voltage is applied to the signal electrode for the duration tH2 or tH4, the voltage V2 or V4 supplied to the signal electrode for a duration t6 immediately before the start of the duration tH2 or tH4 is retained in the signal electrode. Accordingly, FIGS. 9D and 9E are shown as if the voltage V2 or V4 continues to be supplied to the signal electrode from the signal electrode driving circuit 22 even for the duration tH2 or tH4.

As is apparent from Table 2 and FIGS. 9A to 9E, the correction reference voltage V2' or V4' is applied to the signal electrode via the power source line V2" or V4" of the power source circuit 24 when the correction duration control signal T2 is high and the output of the signal electrode driving circuit 22 is not in the high-impedance state (i.e., the display data $D_n$ of the current scanning line is different from the display data $D_{n-1}$ of a scanning line immediately before the current scanning line). The correction reference voltages V2' and V4' are indicated as (V2') and (V4'), respectively, in Table 2.

Thus, the signal electrode driving circuit 22 of this example is configured so that, when the signal voltage waveform is dulled, the correction reference voltage V2' or V4' for correcting the dulled waveform is applied to the signal electrode during the driving of one scanning line (one scanning period). With this configuration, it is possible to apply the correction reference voltage V2' or V4' obtained by superimposing the correction voltage ΔV2 or ΔV4 to the normal signal voltage V2 or V4 to the signal electrode in a scanning period TS1 in which the signal voltage corresponding to display data has changed from that in the preceding period.

The effective values of the signal voltages applied to all the signal electrodes can be made identical, not depending on display data, by setting the duration t1 in which the correction reference voltage V2' or V4' is applied and the correction reference voltage V2' or V4' at optimal values in consideration of the size of the liquid crystal panel, the characteristics of the liquid crystal material, and the like. As a result, the crosstalk can be greatly reduced.

Further, according to the configuration of Example 2, the number of driving voltage lines connected to the signal electrode driving circuit 22 and the number of switching elements in the output portion of the signal electrode driving circuit 22 can be reduced to half of that required in Example 1. This greatly reduces the area of an IC chip in which portions of the signal electrode driving circuit 22 is packaged, providing advantages on cost and size reduction.

In Example 2, two levels of voltages V2' and V4' were used as the correction reference voltage. However, as in Example 1, the same results can be obtained by using only one of the two correction reference voltages for simplification of the circuit, and the like, and increasing the correction amount to compensate the omission of one correction reference voltage.

The configuration of the liquid crystal display device of this invention is not limited to those described in the above examples. For example, though the correction duration control signal T1 or T2 was supplied externally in the above examples, they can be generated internally in the signal electrode driving circuit, and the like.

In the above examples, based on the voltage averaging method used as the method for driving the liquid crystal panel, the voltage V3 applied to the scanning electrodes when not selected is GND. The voltages V1 and V5 applied to the scanning electrodes when selected are ±Vop(1−1/a) when the bias ratio is 1/a. The voltages V2 and V4 corresponding to display data applied to the signal electrodes are ±(Vop/a).

The present invention is not limited to the above method. For example, a driving method using voltages different from the above values can be employed. According to this driving method, two voltages Vop(1−1/a) and Vop/a are used as the voltage applied to the scanning electrodes when not selected. A voltage Vop or GND is used as the voltage applied to the scanning electrodes when selected. Voltages Vop and Vop(1−2/a) or 2Vop/a and GND are applied to the signal electrodes in correspondence with display data. In this case, however, since four signal voltages are used in the signal electrode driving circuit, it is necessary to increase the number of correction reference voltages and the like appropriately.

Further, the present invention is effective in reducing the crosstalk caused by waveform dulling not only for the liquid crystal display device where only binary display is possible (including gray-level display by frame decimation), but also for a liquid crystal display device using pulse width modulation or amplitude modulation.

Figure 13:
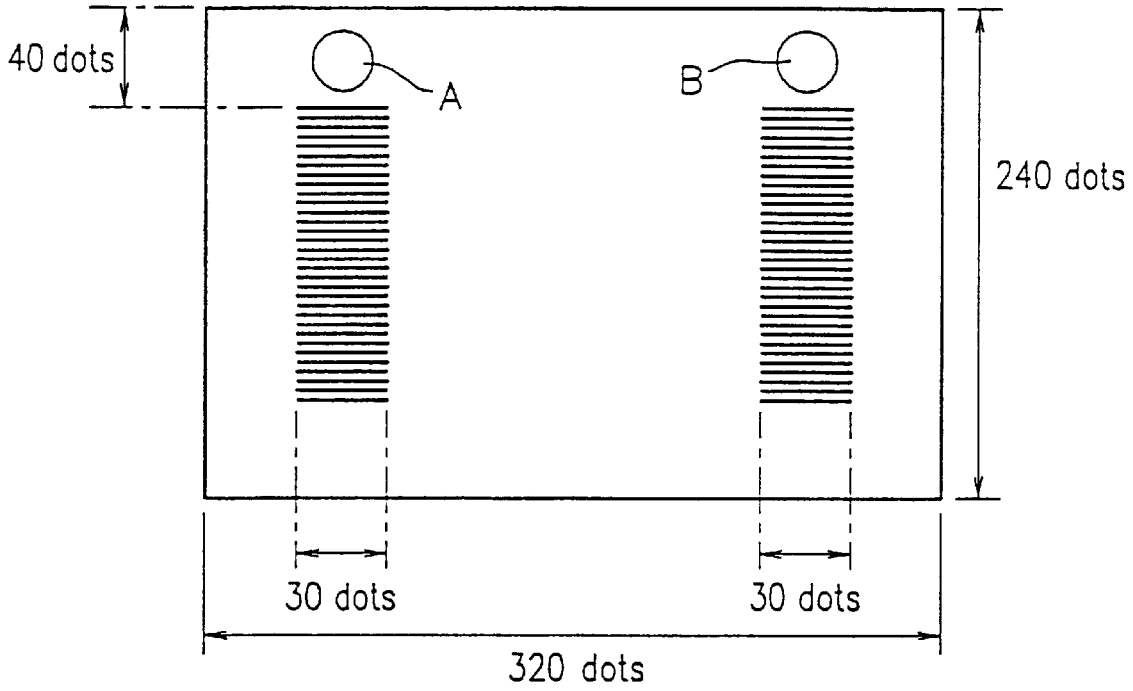
FIG. 13 shows measuring points A and B at the measurement of the crosstalk rate when the present invention is applied to an STN type color liquid crystal panel.

To measure the crosstalk ratio, a driving waveform according to the present invention was generated using a simulated circuit and applied to an STN type color liquid crystal panel. FIG. 13 shows the measurement of the crosstalk ratio. The STN type color liquid crystal display had a size of 320 dots in length×240 dots in width and was driven at a frame frequency of 120 Hz. The crosstalk ratio was measured at measuring points A and B shown in FIG. 13. The crosstalk ratio is represented by $\{(L_x/L)-1\}\times 100(\%)$ where L is the luminance obtained when white display covers the entire surface of the liquid crystal panel and $L_x$ is the luminance obtained when the image shown in FIG. 13 is displayed.

It was found from the results of the above measurement that the crosstalk was greatly reduced by employing the driving waveform using the correction reference voltages according to the present invention, compared with the case employing a driving waveform generated by a conventional driving circuit. Specifically, the crosstalk ratio improved to 0% from −17.6% at the measuring point A and −2.1% from −12.3% at the measuring point B.

The liquid crystal display device according to the present invention includes a means for correcting a reduction of the effective value of a signal voltage applied to the signal electrodes of the liquid crystal panel caused by dulling of the signal voltage waveform when the signal voltage varies in correspondence with display data. With this configuration, crosstalk which significantly deteriorates the display quality of the liquid crystal display device greatly reduces, increasing the display contrast of the liquid crystal display device. The method of reducing crosstalk according to the present invention consumes less power compared with the conventional method.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display device comprising a liquid crystal panel having a plurality of scanning electrodes including first and second scanning electrodes, a plurality of signal electrodes including a first signal electrode, and a liquid crystal layer interposed between the plurality of scanning electrodes and the plurality of signal electrodes, display being conducted based on display data including first and second display data, the liquid crystal display device further comprising:

scanning electrode driving means which outputs a scanning voltage to the first scanning electrode in a first scanning line period and outputs a scanning voltage to the second scanning electrode in a second scanning line period following the first scanning line period; and signal electrode driving means which outputs a first voltage corresponding to the first display data to the first signal electrode in the first scanning line period and outputs a second voltage corresponding to the second display data to the first signal electrode in the second scanning line period, wherein the signal electrode driving means compares the first display data and the second display data and, when the first display data and the second display data are different, outputs a third voltage for correcting a reduction of an effective voltage of the second voltage for a correction duration in the second scanning line period.

2. A liquid crystal display device according to claim 1, wherein the signal electrode driving means is provided for each of the plurality of signal electrodes.

3. A liquid crystal display device according to claim 1, wherein an absolute value of the third voltage is larger than an absolute value of the second voltage.

4. A liquid crystal display device according to claim 1, wherein the signal electrode driving means comprises power source means for generating voltages including the first, second, and third voltages.

5. A liquid crystal display device according to claim 1, wherein the signal electrode driving means compares the first display data and the second display data and, when the first display data and the second display data are the same, outputs the second voltage to the first signal electrode over the entire second scanning period.

6. A liquid crystal display device according to claim 4, wherein the signal electrode driving means further comprises voltage switching means for selecting the second voltage or the third voltage as an output of the power source means and output switching means for outputting the second voltage or the third voltage to the first signal electrode or putting an output of the signal electrode driving means in a high-impedance state, and the signal electrode driving means compares the first display data and the second display data and, when the first display data and the second display data are the same, puts the output of the signal electrode driving means in the high-impedance state using the output switching means in the correction duration, while outputting the second voltage to the first signal electrode in the second scanning period excluding the correction duration.

7. A liquid crystal display device according to claim 5, wherein the correction duration is as long as the second scanning period.

8. A method for driving a liquid crystal display device comprising a liquid crystal panel having a plurality of scanning electrodes including first and second scanning electrodes, a plurality of signal electrodes including a first signal electrode, and a liquid crystal layer interposed between the plurality of scanning electrodes and the plurality of signal electrodes, display being conducted based on display data including first and second display data, the method comprising the steps of:

(A) allowing scanning electrode driving means to output a scanning voltage to the first scanning electrode in a first scanning line period and output a scanning voltage to the second scanning electrode in a second scanning line period following the first scanning line period;

(B) allowing signal electrode driving means to output a first voltage corresponding to the first display data to the first signal electrode in the first scanning line period and output a second voltage corresponding to the second display data to the first signal electrode in the second scanning line period;

(C) allowing the signal electrode driving means to compare the first display data and the second display data; and (D) allowing the signal electrode driving means to output a third voltage for correcting a reduction of an effective voltage of the second voltage for a correction duration in the second scanning line period when the first display data and the second display data are different.

9. A method according to claim 8, wherein the steps (B), (C), and (D) are conducted for each of the plurality of signal electrodes.

10. A method according to claim 8, wherein the step (D) includes the step of allowing the signal electrode driving means to output the second voltage to the first signal electrode over the entire second scanning period when the first display data and the second display data are the same.

11. A method according to claim 8, wherein the step (D) includes the step of allowing the signal electrode driving means to put the output of the signal electrode driving means in a high-impedance state in the correction duration when the first display data and the second display data are the same, and the step of allowing the signal electrode driving means to output the second voltage to the first signal electrode in the second scanning period excluding the correction duration when the first display data and the second display data are the same.

12. A liquid crystal display device comprising a liquid crystal panel having a liquid crystal layer between a plurality of signal electrodes and a plurality of scanning electrodes formed to cross each other, the device further comprising:

signal electrode driving means for applying a voltage corresponding to display data for displaying images on the liquid crystal panel to the plurality of signal electrodes;

scanning electrode driving means for applying a scanning voltage to the plurality of scanning electrodes sequentially; and voltage generating means for supplying voltages required for driving the signal electrode driving means and the scanning electrode driving means to the signal electrode driving means and the scanning electrode driving means, wherein the signal electrode driving means detects whether or not the display data corresponding to a current scanning line period has changed from the display data corresponding to a scanning line period immediately before the current scanning line period for each of the plurality of signal electrodes and outputs, when no change is detected, a normal signal voltage level or, when a change is detected, a correction reference voltage for correcting a reduction of an effective voltage caused by waveform dulling due to the change, to each of the plurality of signal electrodes for a predetermined duration in the current scanning line period.

13. A liquid crystal display device according to claim 12, wherein the voltage generating means is configured so that it can generate at least one level of the correction reference voltage as voltage levels to be supplied to the signal electrode driving means, and the signal electrode driving means is configured so that output means thereof can selectively output the at least one level of the correction reference voltage, supplied from the voltage generating means, and the signal electrode driving means detects whether or not the display data corresponding to a current scanning period has changed from the display data corresponding to a scanning period immediately before the current scanning period for each of the plurality of signal electrodes and outputs the normal signal voltage level when no change is detected or the correction reference voltage when a change is detected, to each of the plurality of signal electrodes for a predetermined duration in the current scanning period.

14. A liquid crystal display device according to claim 12, wherein the voltage generating means has a function of generating at least one level of the correction reference voltage as voltage levels to be supplied to the signal electrode driving means, and comprises voltage switching means for outputting the correction reference voltage instead of the normal signal voltage level for a predetermined duration in the current scanning period to supply to the signal electrode driving means, and the signal electrode driving means can select the normal signal voltage level or a high-impedance state as an output, and the signal electrode driving means detects whether or not the display data corresponding to the current scanning period has changed from the display data corresponding to the scanning period immediately before the current scanning period for each of the plurality of signal electrodes and, when no change is detected, put the output in the high-impedance state for a predetermined duration in a scanning period corresponding to a voltage switching period of the voltage generating means or, when a change is detected, selects a signal voltage which is switched to the correction reference voltage level by the voltage switching means for a predetermined duration in the current scanning period.

* * * * *